US011686123B2

(12) United States Patent
Escofet Via

(10) Patent No.: US 11,686,123 B2
(45) Date of Patent: Jun. 27, 2023

(54) DOOR LOCK WITH DISPLAY UNIT

(71) Applicant: Carrier Corporation, Palm Beach Gardens, FL (US)

(72) Inventor: Jordi Escofet Via, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 488 days.

(21) Appl. No.: 16/636,854

(22) PCT Filed: Aug. 8, 2018

(86) PCT No.: PCT/US2018/045717
§ 371 (c)(1),
(2) Date: Feb. 5, 2020

(87) PCT Pub. No.: WO2019/032647
PCT Pub. Date: Feb. 14, 2019

(65) Prior Publication Data

US 2020/0173194 A1 Jun. 4, 2020

(30) Foreign Application Priority Data

Aug. 8, 2017 (EP) ..... 17382561

(51) Int. Cl.
*E05B 41/00* (2006.01)
*E05B 17/10* (2006.01)
(Continued)

(52) U.S. Cl.
CPC ..... *E05B 41/00* (2013.01); *E05B 17/10* (2013.01); *E05B 17/226* (2013.01); *E05B 45/06* (2013.01);
(Continued)

(58) Field of Classification Search
CPC ..... E05B 41/00; E05B 17/10; E05B 17/226; E05B 45/06; E05B 2047/0071; G08B 13/08; Y10T 70/8027
(Continued)

(56) References Cited

U.S. PATENT DOCUMENTS 2,565,669 A 8/1951 Smith
3,336,775 A 8/1967 Russell et al.
(Continued)

FOREIGN PATENT DOCUMENTS

CN 102829917 A * 12/2012
CN 106050089 A 10/2016
(Continued)

OTHER PUBLICATIONS

Delaney, John, "The Best Smart Locks for 2020", available at: https://in.pcmag.com/surveillance-cameras/103436/the-best-smart-locks, accessed Feb. 4, 2020, 33 pages.
(Continued)

*Primary Examiner* — Suzanne L Barrett
(74) *Attorney, Agent, or Firm* — Cantor Colburn LLP

(57) ABSTRACT

Provided are electronic door locks, systems, and computer implemented methods of use. In one example, the electronic door lock includes a locking mechanism configured to change a state of a door of a room between a locked state and an unlocked state. The electronic door lock further includes a communications interface configured to communicate wirelessly or wired with one or more fire devices. The one of more fire devices are configured to transmit a wireless or wired alert signal to the communications interface in response to detecting an occurrence of fire. The electronic door lock further includes a display unit configured to display an alert upon the communications interface receiving the wireless alert signal from the one or more fire
(Continued)

devices, and configured to display an indication as to occupancy of the room.

12 Claims, 5 Drawing Sheets

(51) Int. Cl.
*E05B 17/22* (2006.01)
*E05B 45/06* (2006.01)
*G08B 13/08* (2006.01)
*E05B 47/00* (2006.01)

(52) U.S. Cl.
CPC ..... *G08B 13/08* (2013.01); *E05B 2047/0071* (2013.01)

(58) Field of Classification Search
USPC ..... 70/432
See application file for complete search history.

(56) References Cited

U.S. PATENT DOCUMENTS

| | | | | |
|---|---|---|---|---|
| 7,391,319 | B1 | 6/2008 | Walker | |
| 7,994,928 | B2 * | 8/2011 | Richmond | G08B 17/10 340/541 |
| 9,087,246 | B1 | 7/2015 | Chin et al. | |
| 9,342,936 | B2 | 5/2016 | Scalisi | |
| 9,396,599 | B1 | 7/2016 | Mallhotra | |
| 9,530,262 | B2 | 12/2016 | Johnson | |
| 9,558,639 | B2 * | 1/2017 | Modi | G08B 13/08 |
| 2004/0090327 | A1 * | 5/2004 | Soloway | G08B 25/008 340/545.1 |
| 2006/0114099 | A1 | 6/2006 | Deng et al. | |
| 2009/0027194 | A1 | 1/2009 | Mcgrath | |
| 2011/0121940 | A1 | 5/2011 | Jones | |
| 2012/0032527 | A1 * | 2/2012 | Weidner | G08B 25/008 307/117 |
| 2013/0099919 | A1 * | 4/2013 | Cai | G01C 21/206 340/539.13 |
| 2015/0097687 | A1 * | 4/2015 | Sloo | G08B 21/182 340/632 |
| 2015/0330652 | A1 | 11/2015 | Kim | |
| 2015/0347916 | A1 | 12/2015 | Warren et al. | |
| 2015/0379795 | A1 | 12/2015 | Wu | |
| 2016/0189496 | A1 | 6/2016 | Modi et al. | |
| 2016/0284206 | A1 | 9/2016 | Boettcher et al. | |
| 2017/0005825 | A1 | 1/2017 | Kim et al. | |

FOREIGN PATENT DOCUMENTS

| | | | | |
|---|---|---|---|---|
| CN | 110084984 | A * | 8/2019 | A62B 1/20 |
| CN | 113658401 | A * | 11/2021 | |
| JP | 3029716 | B2 * | 4/2000 | G08B 25/10 |
| KR | 20120074569 | A | 7/2012 | |
| KR | 20170079122 | A * | 10/2017 | |

OTHER PUBLICATIONS

European Search Report for application EP 17382561.3, dated Dec. 15, 2017, 9 pages.
International Search Report and Written Opinion for application PCT/US2018/045717, 16 pages.

* cited by examiner

DOOR LOCK WITH DISPLAY UNIT

BACKGROUND

Exemplary embodiments pertain to the art of fire detection systems. More particularly, the present disclosure relates to electronic door locks that are integrated with fire detections systems and methods of use.

Door locks have been used in a variety of settings such as hotels, offices, schools, residential buildings, and commercial buildings. Some door locks include smart technology (e.g., RFID, NFC, etc.) so that a physical key is not needed.

Some fire detection systems include fire detectors that are located in rooms and are connected to a remote indicator located in the room to notify the occupants of the room if an occurrence of fire has been detected. However, when a fire occurs a firefighter may have difficulty identifying which room of a multi-room building has a fire and/or is occupied without inspecting the room itself. That leads to a time consuming and dangerous process in which prioritizing the order in which the rooms are inspected is difficult.

As used herein the phrase, "an occurrence of fire" may include, but is not limited to one or more of the following: an occurrence of smoke, heat, flame, carbon monoxide, or other suitable types of occurrences.

BRIEF DESCRIPTION

In one embodiment of the present invention, an electronic door lock is provided that includes a locking mechanism, a communications interface, and a display unit. The locking mechanism is configured to change a state of a door between a locked state and an unlocked state. The communications interface is configured to communicate wirelessly or wired with one or more fire devices, in which the one of more fire devices are configured to transmit a wireless or wired alert signal to the communications interface in response to detecting an occurrence of fire. The display unit is configured to display an alert upon the communications interface receiving the wireless or wired alert signal from the one or more fire devices.

Additionally or alternatively, in this embodiment or other embodiments, the display unit includes one or more light-emitting diode (LEDs), in which the display unit is configured to emit a first color via the one or more LEDs in response to the communications interface receiving the wireless or wired alert signal from the one or more fire devices.

Additionally or alternatively, in this embodiment or other embodiments, the display unit is configured to emit a second color via the one or more LEDs in an absence of receiving the wireless or wired alert signal from the one or more fire devices.

Additionally or alternatively, in this embodiment or other embodiments, the electronic door lock is positioned on an outside surface of the door of a room and at least a first of the one or more fire devices is positioned within the room. The display unit is further or alternatively configured to display an indication as to occupancy of the room.

Additionally or alternatively, in this embodiment or other embodiments, the electronic door lock includes an embedded reader configured to read one or more RF enabled door keys and to activate the locking mechanism to change the state of the door. The display unit is configured to display an indication of the occupancy of the room based at least in part on the reading of one or more RF enabled keys.

Additionally or alternatively, in this embodiment or other embodiments, the display unit includes a one or more LEDs, in which the display unit is configured to emit a first color via the one or more LEDs in response to the communications interface receiving the wireless or wired alert signal from the one or more fire devices, in which the display unit is configured to emit a second color via the one or more LEDs in response to detecting that the room is occupied.

Additionally or alternatively, in this embodiment or other embodiments, the display unit is configured to emit the second color only if the communications interface receives the wireless or wired alert signal and the room is detected as being occupied.

In another embodiment of the present invention, an electronic door lock is provided that includes a locking mechanism, a communications interface, and a display unit. The locking mechanism is configured to change a state of a door between a locked state and an unlocked state. The communications interface is configured to communicate wirelessly or wired with a central control system. The central control system is configured to communicate with one or more fire devices, in which the one of more fire devices are configured to transmit a wireless or wired alert signal to the central control system in response to detecting an occurrence of fire. The display unit is configured to display an alert upon the communications interface receiving a wireless instruction that is transmitted by the central control system in response to the central control system receiving the wireless alert signal from the one or more fire devices.

Additionally or alternatively, in this embodiment or other embodiments, the display unit includes one or more LEDs in which the display unit is configured to emit a first color via the one or more LEDs in response to the communications interface receiving the wireless instruction from the central control system.

Additionally or alternatively, in this embodiment or other embodiments, the display unit is configured to emit a second color via the one or more LEDs in an absence of receiving the wireless instruction from the central control system.

Additionally or alternatively, in this embodiment or other embodiments, the electronic door lock is positioned on an outside surface of the door of a room, in which at least a first of the one or more fire devices is positioned within the room. The display unit is further or alternatively configured to display an indication as to occupancy of the room.

Additionally or alternatively, in this embodiment or other embodiments, the electronic door lock further includes an embedded reader configured to read one or more RF enabled door keys and to activate the locking mechanism to change the state of the door. The display unit is configured to display an indication of the occupancy of the room based at least in part on the reading of one or more RF enabled keys.

Additionally or alternatively, in this embodiment or other embodiments, the display unit includes one or more LEDs in which the display unit is configured to emit a first color via the one or more LEDs in response to the communications interface receiving the wireless or wired instruction from the central control system, and in which the display unit is configured to emit a second color via the one or more LEDs in response to detecting that the room is occupied.

Additionally or alternatively, in this embodiment or other embodiments, the display unit is configured to emit the second color only if the communications interface receives the wireless or wired instruction from the central control system and the room is detected as being occupied.

In another embodiment of the present invention, a computer-implement method is provided. The method includes receiving, by a communications interface of an electronic door lock, a wireless or wired alert signal transmitted from one or more fire devices in response to the one or more fire devices detecting an occurrence of fire. The method further includes displaying, by a display unit of the electronic door lock, an alert upon the communications interface receiving the wireless or wired alert signal from the one or more fire devices. The method further includes displaying, by the display unit of the door lock, an indication as to occupancy of the room.

Additionally or alternatively, in this embodiment or other embodiments, the display unit includes one or more LEDs in which the display unit is configured to emit a first color via the one or more LEDs in response to the communications interface receiving the wireless instruction from the central control system.

Additionally or alternatively, in this embodiment or other embodiments, the displaying of the alert includes emitting a second color via the one or more LEDs in an absence of receiving the wireless alert signal from the one or more fire devices.

Additionally or alternatively, in this embodiment or other embodiments, the door lock is positioned on an outside surface of a door of a room, and at least a first of the one or more fire devices is positioned within the room.

Additionally or alternatively, in this embodiment or other embodiments, the method further includes reading, by a an embedded reader configured to read one or more RF enabled door keys to change a state of the door between a locked state and an unlocked state, in which the displaying of the indication via the display unit as to the occupancy of the room is in response to the reading of the one or more RF enabled keys.

Additionally or alternatively, in this embodiment or other embodiments, the display unit includes one or more LEDs. The displaying of the alert includes emitting a first color via the one or more LEDs in response to the communications interface receiving the wireless alert signal from the one or more fire devices. The displaying of the indication includes emitting a second color via the one or more LEDs in response to detecting that the room is occupied.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The following descriptions should not be considered limiting in any way. With reference to the accompanying drawings, like elements are numbered alike. The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

A detailed description of one or more embodiments of the disclosed apparatus and method are presented herein by way of exemplification and not limitation with reference to the Figures.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
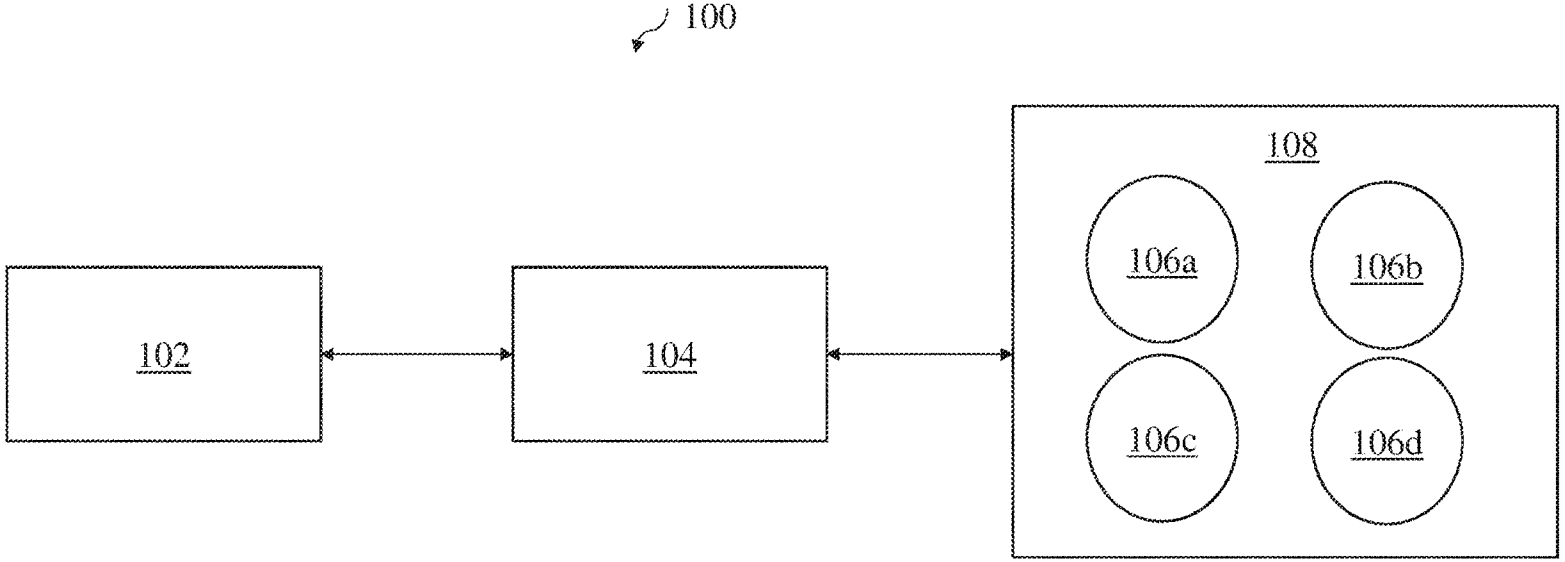
FIG. 1 is a block diagram illustrating an example system in accordance with one or more embodiments of the present invention.

FIG. 1 illustrates a block diagram of an example system 100 in accordance with one or more embodiments of the present invention. System 100 includes an electronic lock 102, a network 104, and one or more fire devices 106*a*, 106*b*, 106*c*, and 106*d*, in which the one or more fire devices 106*a*, 106*b*, 106*c*, and 106*d* are positioned within a room 108. The electronic lock 102 can be placed on or within an outside or inside surface of a door of the room 108.

The electronic lock 102 is configured to display an alert upon receiving an alert signal from the one or more fire devices 106*a*, 106*b*, 106*c*, and 106*d* that indicates that smoke, fire, or carbon dioxide has been detected by the one or more fire devices 106*a*, 106*b*, 106*c*, and 106*d*. The electronic lock 102 may receive the alert via a wireless or wired communication with the one or more fire devices 106*a*, 106*b*, 106*c*, and 106*d* via a network 104. In some embodiments of the present invention, the electronic lock 102 is further configured to display an indication as to the occupancy of the room 108. The electronic lock 102 can be placed on or within an outside or inside surface of a door of the room 108.

The one of more fire devices 106*a*, 106*b*, 106*c*, and 106*d* are configured to detect an occurrence of fire, and to transmit an alert signal to the electronic lock 102 via network 104 in response to detecting an occurrence of fire. The alert signal can be transmitted over a wireless or wired communication channel depending on which type of communication is being conducted between the electronic lock 102 and the one or more fire devices 106*a*, 106*b*, 106*c*, and 106*d*. For example, in some embodiments of the present invention, the communication between the electronic lock 102 and the one or more fire device 106*a*, 106*b*, 106*c*, and 106*d* is conducted over a wireless communication channel, such as by an RF link, a Bluetooth link, a WiFi link, a cellular link, a satellite link, or other suitable types of wireless direct or indirect communication links. In some embodiments of the present invention, the communication between the electronic lock 102 and the one or more fire device 106*a*, 106*b*, 106*c*, and 106*d* is conducted over a wired communication channel, such as via an Ethernet cable, coaxial cable, fiber optics, phone line, or other types of wired direct or indirect communication links.

Figure 2:
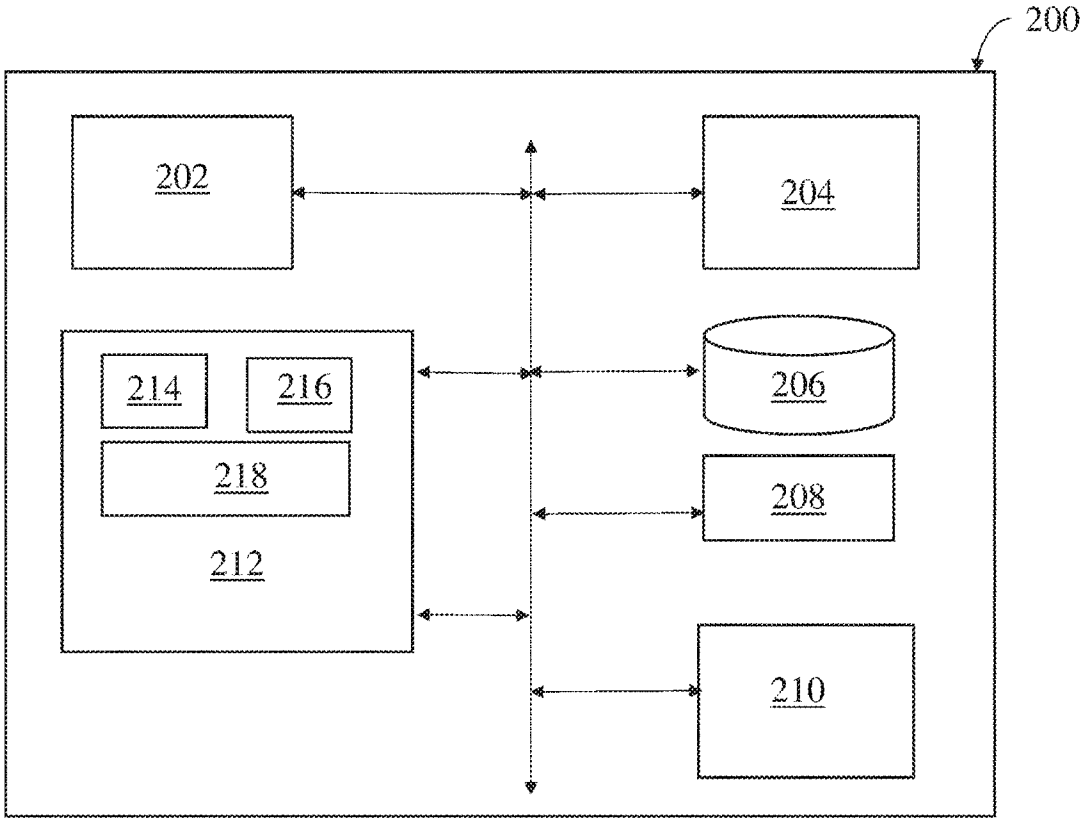
FIG. 2 is block diagram illustrating an example electronic lock in accordance with one or more embodiments of the present invention.

FIG. 2. illustrates a block diagram of an example electronic lock 200 in accordance with one or more embodiments of the present invention. The example electronic lock 200 includes a locking mechanism 202, a communications interface 204, an embedded reader 210, and a display unit 212. Furthermore, in some embodiments of the present invention the electronic lock 102 includes a memory 206 and a processor 208 to facilitate execution of instructions (e.g., computer executable components and corresponding instructions) by the electronic lock 200. As shown, in some embodiments of the present invention the locking mechanism 202, the communications interface 204, the embedded reader 210, display unit 212, memory 206, and/or processor 208 are electrically and/or communicatively coupled to one another.

The locking mechanism 202 is configured to change a state of a door between a locked state and an unlocked state (e.g., from a locked state to an unlocked state and/or from a locked state to an unlocked state). In some embodiments of the present invention, the locking mechanism 202 includes a piston, magnet, or other locking means, and the locking mechanism 202 is configured to change the state of a door through use of the locking means. In some embodiments of the present invention, the locking mechanism 202 changes the state of the door by transmitting an electronic signal to a separate locking system, in which the locking system includes a piston, magnet, or other suitable locking means. In some embodiments of the present invention, the locking mechanism 202 changes the state of the door by mechanically actuating the separate locking system. In some embodiments of the present invention, the locking means may be any suitable electronic, mechanical or chemical device that that can be used to lock and unlock a door.

The communications interface 204 is configured to communicate with one or more fire devices, in which the one of more fire devices are configured to transmit an alert signal to the communications interface in response to detecting an occurrence of fire. As noted above, the communication may be conducted over a wired or wireless communication, and the alert signal may be a wireless or wired alert signal. In some embodiments of the present invention, the electronic door lock 200 is configured to manage an RF interface and to obtain information from the fire detector(s) in the room. In some embodiments this is achieved by, for example, communications interface 204 and an input or a group of inputs representing the different states.

The display unit 212 is configured to display an alert upon the communications interface 204 receiving the alert signal (e.g., wireless alert signal) from the one or more fire devices. In some embodiments of the present invention, the display unit 212 is further configured to display an indication as to the occupancy of a room. In some embodiments of the present invention, the display unit 212 is configured to display the indication as to the occupancy of the room only if the communications interface 204 receives the alert signal and if the room is detected as being occupied.

The various displays of alerts and indications as described provide several benefits. For example, in the event of a fire, a firefighter can review the display units 212 of outside door locks 200 of rooms in a building to determine which rooms a fire has been detected. The displaying of an indication as to the occupancy of a room is also beneficial as firefighters reviewing the display units 212 of multiple electronic door locks 200 may be able to prioritize rooms based on occupancy. Moreover, displaying of the indication as to occupancy only when an occurrence of fire is detected is beneficial in various situations, such as when an end-user of the system wishes for the occupancy information to be privacy protected. Thus when privacy protected is needed an end-user may configure the electronic door lock 200 to display an occupancy indication only during or after an event of fire has been detected.

In some embodiments of the present invention, the display unit 212 of the electronic door lock 200 includes one or more light-emitting diodes (LEDs) 214, 216. In some embodiments of the present invention, the LEDs 214 comprise a single multicolor LED or multiple multicolor LEDs. In some embodiments of the present invention, each LED 214, 216 is a single color LED. In some embodiments of the present invention, the display unit 212 is configure to emit a first color via the one or more LEDs 214, 216 in response to the communications interface 204 receiving the alert signal (e.g., wireless or wired alert signal) from the one or more fire devices. In some embodiments of the present invention, the display unit 212 includes a first LED 214 and the display unit 212 is configure to emit a first color via the first LED 214 in response to the communications interface 204 receiving the alert signal (e.g., wireless or wired alert signal) from the one or more fire devices. In other words, a certain color may be displayed in the event of detecting an occurrence of fire, smoke or carbon monoxide. In some embodiments of the present invention, the display unit 212 includes a textual display 218 and the displaying of the alert via the display unit 212 includes displaying a textual alert via the textual display 218. The textual alert may be indicative of the particular type of received alert signal. For example, in some embodiments of the present invention, the textual alert may say "SMOKE", "FIRE", and/or "CARBON DIOXIDE." Other textual phrases including numbers, letters and/or symbols may be used.

In some embodiments of the present invention, display unit 212 is configured to emit a second color via the one or more LEDs 214, 216. In some embodiments of the present invention, the display unit 212 of the electronic door lock 200 includes a second LED 216 and the display unit 212 is configured to emit a second color via the second LED 216. In some embodiments of the present invention, the display unit 212 is configured to emit the second color via the one or more LEDs 214, 216 when an occurrence of fire has not been detected. In other words, in some embodiments of the present invention, the display unit 212 is configured to emit the second color via the one or more LEDs 214, 216 in an absence of receiving the alert signal from the one or more fire devices.

The embedded reader 210 is configured to read one or more RF enabled door keys to grant or deny access to the room. In some embodiments of the present invention, the embedded reader 210 is an RFID or NFC reader and the embedded reader 210 communicates with the fire devices via wireless or wired communication. In some embodiments of the present invention, the embedded reader 210 is connected via a wired connection with the fire devices to another module that is located near the door and RFID or NFC communication is setup with the embedded reader 210 to the door lock via the module. In some embodiments of the present invention, the embedded reader 210 and/or the processor 208 are configured to activate the locking mechanism 202 to change the state of the door. In some embodiments of the present invention, the display unit 212 is configured to display the indication of the occupancy of the room based at least in part on the reading of one or more RF enabled keys (e.g., NFC keys or RFID keys) by the embedded reader 210. For example, in some embodiments of the present invention, the display unit 212 is configured to emit a second color via the one or more LEDs 214, 216 in response to detecting that the room is occupied. The second color may be emitted when any number of people have been detected as being within the room. Alternatively, in some embodiments of the present invention, the second color may be indicative of the quantity of people that have been detected as being in the room. For example, in some embodiments of the present invention, the second color may be selected from a group of colors in which each color is associated with a different number of people. For example, the second color may be a certain color when less than four people are detected, and the second color may be a different color when four or more people are detected. This can be achieved by, for example, integrating the electronic lock 200 with a presence detection system. Other suitable ranges may be utilized. In some embodiments of the present invention, the display unit 212 includes a textual display 218 and the displaying of the indication via the display unit 212 includes displaying a textual indication. The textual indication may indicate the amount of people that are detected as being in the room or indicate that the room is occupied. For example, in some embodiments of the present invention, the textual indication may say "ONE", "TWO", "THREE", or other numbers. Other textual indications including numbers, letters and/or symbols may be used.

Figure 3:
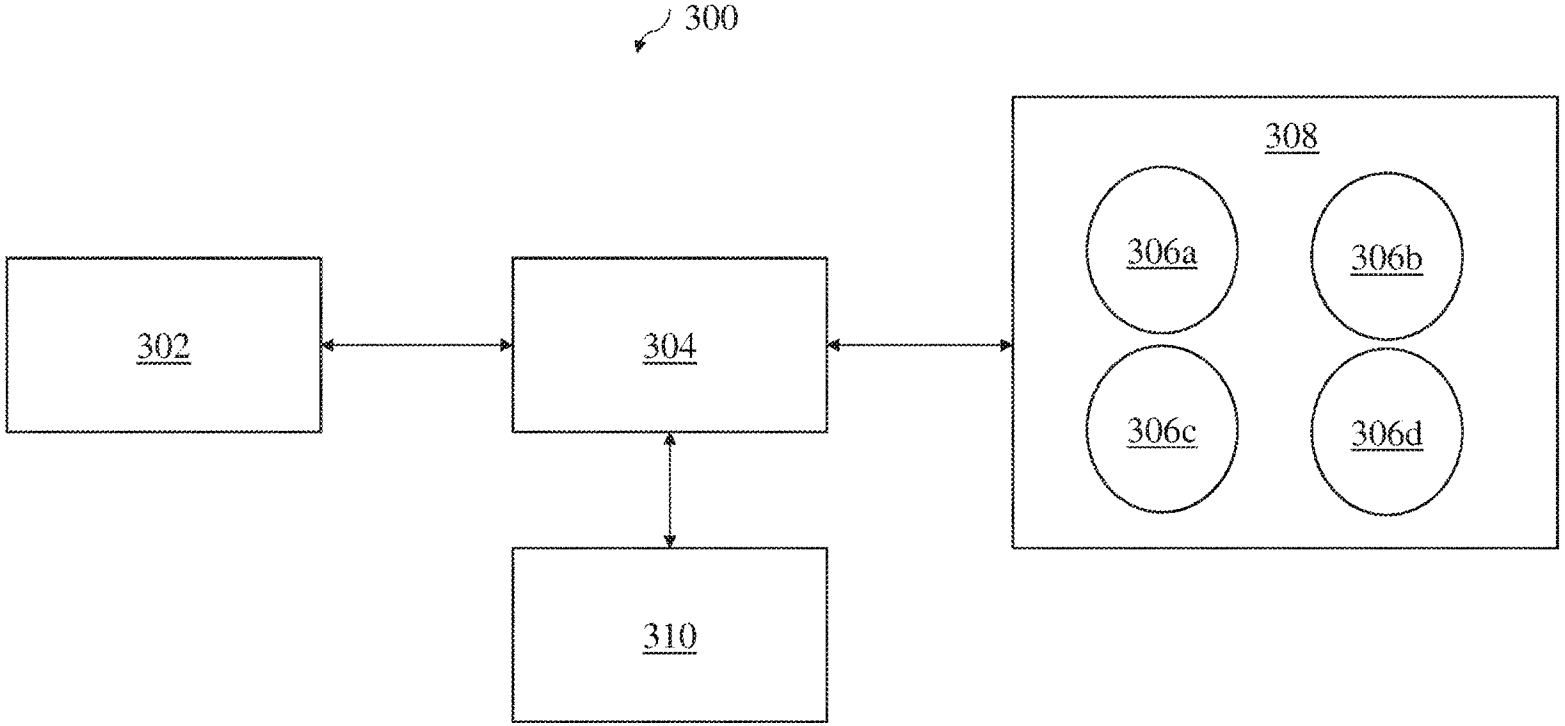
FIG. 3 is a block diagram illustrating another example system in accordance with one or more embodiments of the present invention.

FIG. 3 illustrates a block diagram of another example system 300 in accordance with one or more embodiments of the present invention. System 300 includes an electronic lock 302, a network 304, one or more fire devices 306*a*, 306*b*, 306*c*, and 306*d*, and a central control system 310. The one or more fire devices 306*a*, 306*b*, 306*c*, and 306*d* are positioned within a room 308. The electronic lock 302 can be placed on or within an outside or inside surface of a door of the room 308.

The electronic lock 302 is configured to display an alert upon receiving a instruction from the central control system 310 indicating that the central control system 310 received an alert signal from the one or more fire devices 306*a*, 306*b*, 306*c*, and 306*d* indicating that an occurrence of fire has been detected by the one or more fire devices 306*a*, 306*b*, 306*c*, and 306*d*. The electronic lock 302 may receive the instruction from central control system 310 over a wireless or wired communication channel. In some embodiments, the central control system may be located near the electronic lock 302 and/or the one or more fire devices 306*a*, 306*b*, 306*c*, and 306*d*. In some embodiments, the central control system 310 may be located at a remote location (e.g., in a different building, different floor, different room, etc.).

The central control system 310 may receive the alert via a wireless or wired communication channel with the one or more fire devices 306*a*, 306*b*, 306*c*, and 306*d* via network 304. The one of more fire devices 306*a*, 306*b*, 306*c*, and 306*d* are configured to detect an occurrence of fire, and to transmit an alert signal to the central control system 310 via network 304 in response to detecting an occurrence of fire.

The alert signal can be transmitted over a wired or wireless communication channel depending on which type of communication is being conducted between the central control system 310 and the one or more fire devices 306*a*, 306*b*, 306*c*, and 306*d*. For example, in some embodiments of the present invention, the communication between the central control system 310 and the one or more fire device 306*a*, 306*b*, 306*c*, and 306*d* comprises a wireless communication channel, such as by an RF link, a Bluetooth link, a WiFi link, a cellular link, a satellite link, or other suitable types of wireless direct or indirect communication links. In some embodiments of the present invention, the communication between the central control system 310 and the one or more fire device 306*a*, 306*b*, 306*c*, and 306*d* comprises a wired communication channel, such as via an Ethernet cable, coaxial cable, fiber optics, phone line, or other types of wired direct or indirect communication links.

Similarly, the instruction can be transmitted from the central control system 310 to the electronic door lock 302 over a wireless or wired communication channel depending on which type of communication is being conducted between the central control system 310 and the electronic door lock 302. For example, in some embodiments of the present invention, the communication between the central control system 310 and the electronic door lock 302 is conducted over a wireless communication channel, such as by an RF link, a Bluetooth link, a WiFi link, a cellular link, a satellite link, or other suitable types of wireless direct or indirect communication links. In some embodiments of the present invention, the communication between the central control system 310 and the electronic door lock 302 is conducted over a wired communication channel, such as via an Ethernet cable, coaxial cable, fiber optics, phone line, or other types of wired direct or indirect communication links.

In some embodiments of the present invention, the electronic lock 302 is further configured to display an indication as to the occupancy of the room 308. Different colors can be emitted from the electronic door lock 302 in a manner similar to the ones described above in reference to FIG. 1 and FIG. 2. For example, the emitting of the colors may be based on whether a display unit of the electronic door lock 302 receives an instruction (e.g., wireless or wired instruction) that is transmitted by the central control system 310 in response to the central control system receiving an alert from the one or more fire devices 306*a*, 306*b*, 306*c*, and 306*d* that an event of fire has been detected. Moreover, as noted above, in some embodiments of the present invention, a color is emitted based on whether the room 308 is detected as being occupied.

Figure 4:
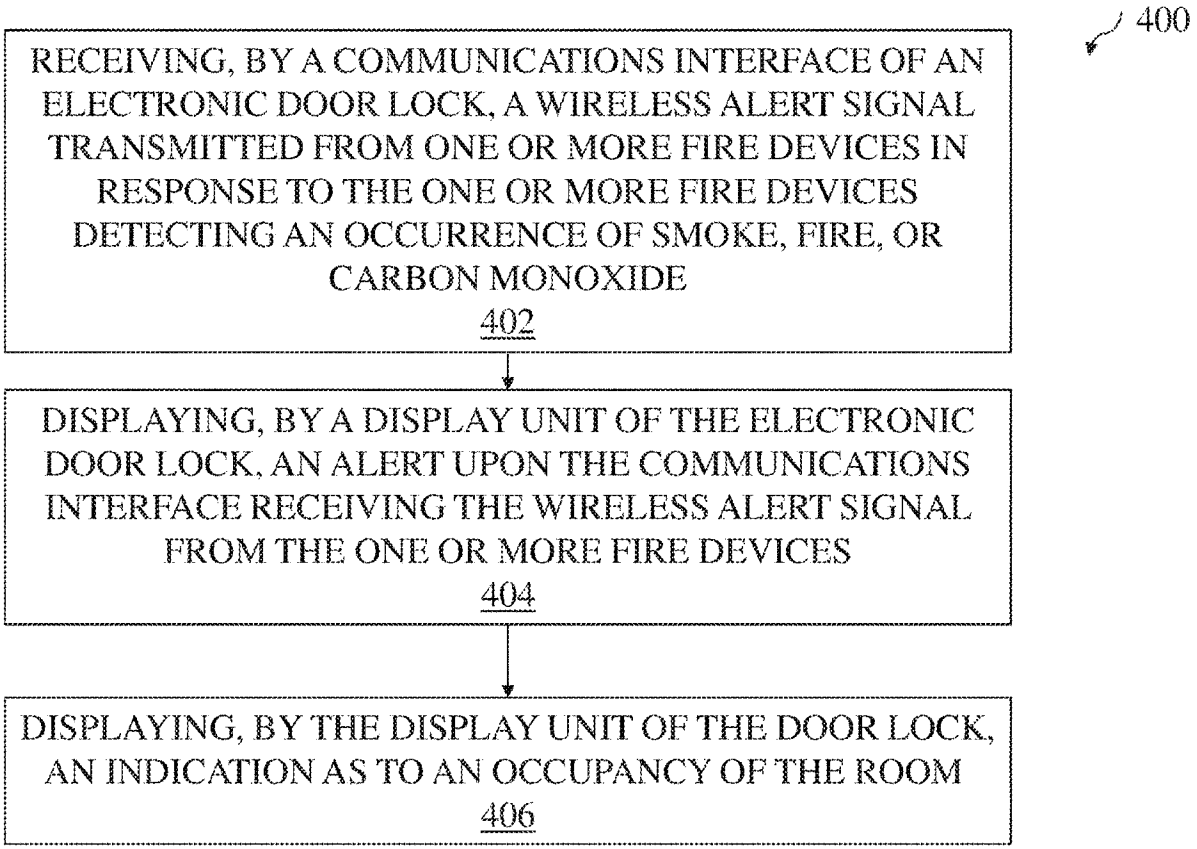
FIG. 4 is flow diagram illustrating an example methodology in accordance with one or more embodiments of the present invention.

Additional details of the operation of systems 100, 200, 300 will now be described with reference to FIG. 4, in which FIG. 4 depicts a flow diagram illustrating a methodology 400 according to one or more embodiments of the present invention. At 402, a wireless or wired alert signal is received by a communications interface of an electronic door lock, in which the wireless or wired alert signal was transmitted from one or more fire devices to the electronic in response to the one or more fire devices detecting an occurrence of fire At 404, an alert is displayed by a display unit of the electronic door lock upon the communications interface receiving the wireless or wired alert signal from the one or more fire devices. At 406, an indication as to occupancy of the room is displayed by the display unit of the door lock.

In some embodiments of the present invention, the methodology includes one or more RF enabled door keys being read by an reader embedded in the electronic door lock, in which the keys are read to change a state of the door between a locked state and an unlocked state (e.g., from a locked state to an unlocked state and/or from an unlocked state to a locked state). The displaying of the indication via the display unit as to occupancy in the room is in response to the reading of the one or more RF enabled keys.

In some embodiments of the present invention, the display unit of electronic door lock of the methodology includes one or more LEDs, in which the display unit is configured to emit a first color via the one or more LEDSs in response to the communications interface receiving the wireless or wired instruction from the central control system. In some embodiments of the present invention, the displaying of the alert includes emitting a second color via the one or more LEDs in an absence of receiving the wireless or wired alert signal from the one or more fire devices. In some embodiments of the present invention, the door lock is positioned on an outside surface of a door of a room and at least a first of the one or more fire devices is positioned within the room.

In some embodiments of the present invention, the display unit of the electronic door lock of the methodology includes one or more LEDs, in which the displaying of the alert includes emitting a first color via the one or more LEDs in response to the communications interface receiving the wireless or wired alert signal from the one or more fire devices, and in which the displaying of the indication includes emitting a second color via the second LED in response to detecting that the room is occupied.

Figure 5:
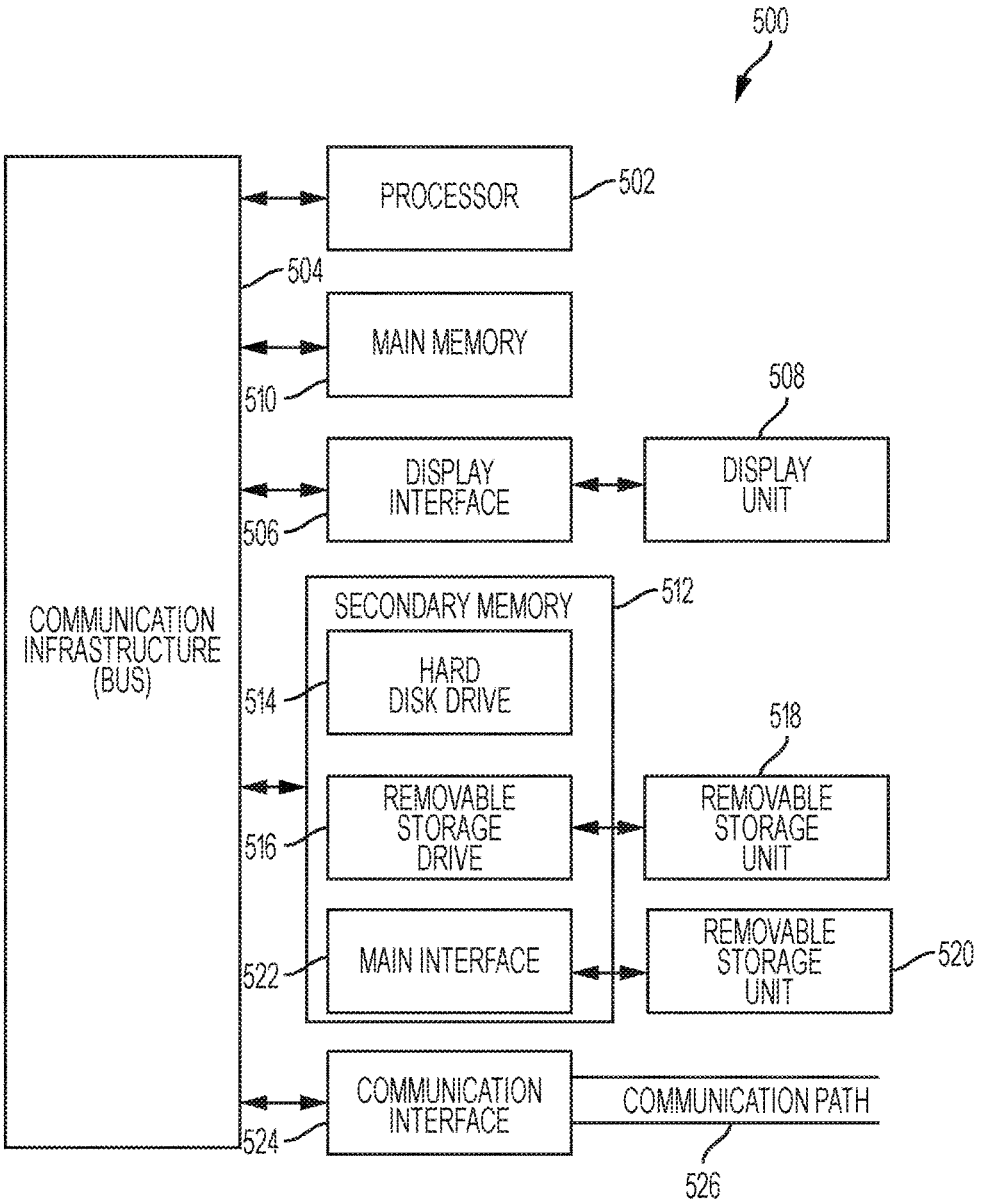
FIG. 5 is a block diagram illustrating an example computer system capable of implementing one or more embodiments of the present invention.

FIG. 5 illustrates a high level block diagram showing an example of a computer-based system 500 useful for implementing one or more embodiments of the invention, such as some of the components of the electronic locks, central control systems, and fire devices described herein. Although one exemplary computer system 500 is shown, computer system 500 includes a communication path 526, which connects computer system 500 to additional systems and may include one or more wide area networks (WANs) and/or local area networks (LANs) such as the internet, intranet(s), and/or wireless communication network(s). Computer system 500 and additional system are in communication via communication path 526, (e.g., to communicate data between them).

Computer system 500 includes one or more processors, such as processor 502. Processor 502 is connected to a communication infrastructure 504 (e.g., a communications bus, cross-over bar, or network). Computer system 500 can include a display interface 506 that forwards graphics, text, and other data from communication infrastructure 504 (or from a frame buffer not shown) for display on a display unit 508. The display interface 506 can also or alternatively include one or more LEDs. Computer system 500 also includes a main memory 510, such as for example, random access memory (RAM), and may also include a secondary memory 512. Secondary memory 512 may include, for example, a hard disk drive 514 and/or a removable storage drive 516, representing, for example, a floppy disk drive, a magnetic tape drive, a USB drive, an SD card, an optical disk drive or other suitable type of removal storage media. Removable storage drive 516 reads from and/or writes to a removable storage unit 518 in a manner well known to those having ordinary skill in the art. Removable storage unit 518 represents, for example, a floppy disk drive, a magnetic tape drive, a USB drive, an SD card, an optical disk drive, etc. which is read by and written to by removable storage drive 516. As will be appreciated, removable storage unit 518 includes a computer readable medium having stored therein computer software and/or data.

In some alternative embodiments of the invention, secondary memory 512 may include other similar means for allowing computer programs or other instructions to be loaded into the computer system. Such means may include, for example, a removable storage unit 520 and an interface 522. Examples of such means may include a program package and package interface (such as that found in video game devices), a removable memory chip (such as an EPROM or PROM) and associated socket, and other removable storage units 520 and interfaces 522 which allow software and data to be transferred from the removable storage unit 520 to computer system 500.

Computer system 500 may also include a communications interface 524. Communications interface 524 allows software and data to be transferred between the computer system and external devices. Examples of communications interface 524 may include a modem, a network interface (such as an Ethernet card), a communications port, or a PCM-CIA slot and card, etcetera. Software and data transferred via communications interface 524 are in the form of signals which may be, for example, electronic, electromagnetic, optical, or other signals capable of being received by communications interface 524. These signals are provided to communications interface 524 via communication path (i.e., channel) 526. Communication path 526 carries signals and may be implemented using wire or cable, fiber optics, a phone line, a cellular phone link, an RF link, and/or other communications channels.

In the present disclosure, the terms "computer program medium," "computer usable medium," and "computer readable medium" are used to generally refer to media such as main memory 510 and secondary memory 512, removable storage drive 516, and a hard disk installed in hard disk drive 514. Computer programs (also called computer control logic) are stored in main memory 510, and/or secondary memory 512. Computer programs may also be received via communications interface 524. Such computer programs, when run, enable the computer system to perform the features of the present disclosure as discussed herein. In particular, the computer programs, when run, enable processor 502 to perform the features of the computer system. Accordingly, such computer programs represent controllers of the computer system.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide, or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments of the invention, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An electronic door lock controller operable to perform door lock control operations comprising:

receiving an emergency-state signal from one or more emergency-state sensors that have detected an emergency-state within an area that can be entered through a door;

responsive to the emergency-state signal:

generating an occupancy alert that indicates that the area is occupied;

generating an emergency-state alert that indicates that an emergency has occurred within the area; and controlling a locking mechanism to change a state of the door between a locked state and an unlocked state; and controlling a display unit to display the emergency-state alert and the occupancy alert to a person who is outside the area when the door is closed.

2. The electronic door lock controller of claim 1, wherein the display unit is integrated with an electronic door lock positioned on an outside surface of the door.

3. The electronic door lock controller of claim 2, wherein generating the occupancy alert is based at least in part on an analysis of an embedded radio frequency identification (RFID) or near field communication (NFC) reader operable to read one or more RFID or NFC enabled door keys of the door.

4. The electronic door lock controller of claim 1, wherein the display unit is operable to:

emit a first color via one or more light emitting diodes (LEDs) in response to the emergency-state alert; and emit a second color via the one or more LEDs in response to the occupancy alert.

5. The electronic door lock controller of claim 4, wherein the display unit is operable to emit the second color only if the controller receives the emergency-state signal.

6. The electronic door lock controller of claim 1, wherein the electronic door lock controller is integrated within an electronic door lock.

7. The electronic door lock controller of claim 1, wherein the electronic door lock controller comprises a central control system.

8. A computer-implemented method comprising:

receiving, using an electronic door lock controller, an emergency-state signal from one or more emergency-state sensors that have detected an emergency-state within an area that can be entered through a door;

responsive to the emergency-state signal:

generating an occupancy alert that indicates that the area is occupied;

generating an emergency-state alert that indicates that an emergency has occurred within the area; and controlling a locking mechanism to change a state of the door between a locked state and an unlocked state; and controlling a display unit to display the emergency-state alert and the occupancy alert to a person who is outside the area when the door is closed.

9. The computer-implemented method of claim 8, wherein the display unit is operable to:

emit a first color via one or more light emitting diodes (LEDs) in response to the emergency-state alert; and emit a second color via the one or more LEDs in response to the occupancy alert.

10. The computer-implemented method of claim 9, wherein the display unit is operable to emit the second color only if the electronic door lock controller receives the emergency-state signal.

11. The computer-implemented method of claim 8, wherein the display unit is integrated with an electronic door lock positioned on an outside surface of the door.

12. The computer-implemented method of claim 8, wherein generating the occupancy alert is based at least in part on an analysis of an embedded radio frequency identification (RFID) or near field communication (NFC) reader operable to read one or more RFID or NFC enabled door keys of the door.

* * * * *